United States Patent [19]

Lin

[11] Patent Number: 4,611,416

[45] Date of Patent: Sep. 16, 1986

[54] ATHLETIC SHOE WITH DISPLAY PORTION AND METHOD OF MAKING

[76] Inventor: Danny Lin, 132 Duane St., New York, N.Y. 10013

[21] Appl. No.: 594,653

[22] Filed: Mar. 29, 1984

[51] Int. Cl.[4] ..... A43B 23/24; G09F 3/18

[52] U.S. Cl. ..... 36/136; 36/132; 2/245

[58] Field of Search ..... D2/309; 36/132, 136; 2/243, 244, 245

[56] References Cited

U.S. PATENT DOCUMENTS

| | | | |
|---|---|---|---|
| 143,392 | 1/1846 | Barlow . | |
| D. 261,695 | 11/1981 | Gamm | D2/309 |
| 294,020 | 2/1884 | Eisendrath . | |
| 537,364 | 4/1895 | Rogers . | |
| 1,502,919 | 7/1924 | Seib . | |
| 1,952,409 | 3/1934 | Berg | 36/136 |
| 2,478,411 | 8/1949 | Martin . | |
| 2,712,700 | 7/1955 | Solomon . | |
| 2,801,477 | 8/1957 | Adams et al. | 36/136 |
| 3,018,570 | 1/1962 | Bliese . | |
| 3,055,133 | 9/1962 | Anderson | 2/246 |
| 3,631,613 | 1/1972 | Brettell . | |
| 4,280,287 | 7/1981 | Gulbransen . | |
| 4,296,559 | 10/1981 | Gamm . | |
| 4,516,337 | 5/1985 | Adamik | 36/132 |

FOREIGN PATENT DOCUMENTS

| | | |
|---|---|---|
| 37486 | of 0000 | Rep. of Korea . |
| 2110521 | of 0000 | United Kingdom . |

*Primary Examiner*—Werner H. Schroeder
*Assistant Examiner*—Steven N. Meyers
*Attorney, Agent, or Firm*—Nolte, Nolte and Hunter

[57] ABSTRACT

An athletic shoe having a quarter and outer material covering portions thereof providing a window in the covering and an access opening into the space between the quarter and outer material.

2 Claims, 2 Drawing Figures

ATHLETIC SHOE WITH DISPLAY PORTION AND METHOD OF MAKING

BACKGROUND OF THE INVENTION

This invention relates generally to an athletic shoe provided with an outer layer of material overlaying the side, also called the quarter, portion of the upper of the shoe and to such a shoe in which access to the space between the overlying material and the upper is provided to form a pocket opening. More particularly, the invention provides a window in the overlying material for viewing the contents within the pocket or information display cards or the like disposed within the space behind the window.

Pocketed athletic shoes are disclosed in my co-pending applications Ser. No. 505,144, filed June 16, 1983 and Ser. No. 505,134, filed June 16, 1983 which are incorporated herein by reference, and of which this application is a continuation-in-part.

As far as can be determined, it is known to provide a window opening in material sewn to the quarter of a shoe and to display information, such as a trademark, behind the window opening. It is believed that it is also known to provide a transparent window in front of the display and to stitch the transparent window to the outer material about the edges defining the window opening. When the information is displayed on a card, for example, the card as well as the transparent window are stitched along with the edges defining the window opening in the outer material to stabilize the display during fabrication of the shoe. In this respect, the outer material, the window, the display card and the quarter may all be stitched together for stability of the display during fabrication.

As noted, it is known from the disclosures of my prior aforementioned applications and from U.S. Pat. No. 4,296,559, issued to Gamm to provide a pocket between an outer material and the quarter of the shoe with access to the pocket through an opening adjacent the eyestay portion of the shoe.

It is not known, however, prior to the present invention, to provide a window opening in material covering the quarter of the shoe and to also provide access to the space between the covering material and the shoe quarter to provide a display which may be used to view the contents of the pocket, to vary displays behind the display window, and at the same time to provide a stable display without the necessity of stitching a display card and/or window to the shoe during fabrication.

SUMMARY OF THE INVENTION

The present invention takes advantage of the structures which provide a pocket area between the shoe quarter and outer material overlying the same with an access opening adjacent the eyestay portion of the shoe by providing a window in the outer material behind which, and between the outer material and the shoe quarter, a display card may be inserted through the pocket access opening.

In a preferred embodiment of the invention, a transparent window made of a suitable pliable material is sewn to the peripheral edges of the window opening so that the interior of the pocket and the contents thereof may be seen; or so that a card or the like may be inserted in the pocket and information on the card viewed through the window. In this respect, it has been found that the card should preferably substantially conform at its outer periphery to the shape formed by inner boundaries of the pocket, at least along the sides and bottom, so that the card will be stabilized against movement.

In a further preferred embodiment of the invention, the card may be made of smooth surfaced material of any kind upon which information may be written and erased. The card is preferably made of a pliable material to permit bending to facilitate entry and removal through the access opening and conformity to the bending of the shoe quarter during use of the shoe.

With the invention, any manufacturer's trademark may be efficiently and inexpensively provided on a card which is inserted in the pocket and displayed through the window. Instead, the owner's name may appear on the information card. Many other types of indicia may be provided on a card to be inserted behind the display window; e.g., ornamental designs, messages and the like.

The structures of the aforementioned co-pending applications are particularly adapted for use in the invention as it pertains to fabrication of a shoe of the type described, as the outer material comprises a unitary structure forming the pocket and eyestay portions of the shoe and, thus, the provision of a window opening in combination with a display window and/or display card insert shaped to the boundaries of the pocket, eliminates a fabrication step to stabilize the insert or inserts. Alternatively, as noted, the window may be stitched to the outer material in any event.

DETAILED DESCRIPTION OF THE PREFERRED EMBODIMENT

Figure 1:
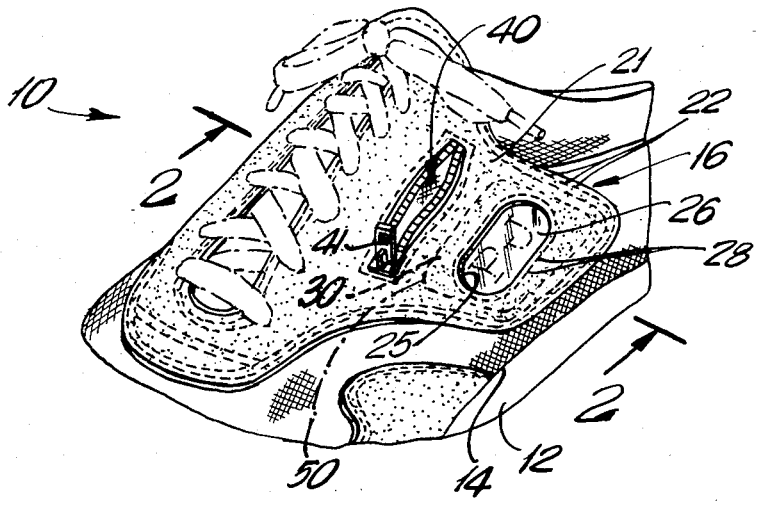
FIG. 1 is a perspective view of an athletic shoe incorporating the display window of the invention.
Figure 2:
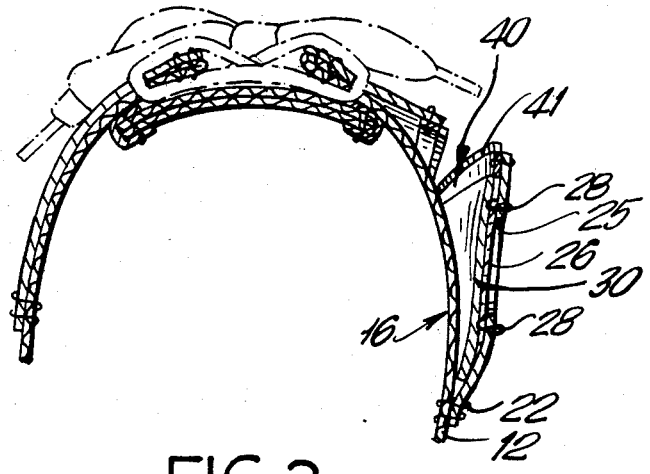
FIG. 2 is a sectional view taken along the lines 2—2 of FIG. 1.

In the figures, there is shown an athletic shoe 10 having a sole portion 12 stitched at its shank 14 to the shoe upper including the bottom of the quarter 16. The upper, as well as other portions of the shoe to be described, may be fabricated of any suitable flexible, natural or synthetic material.

In the particular embodiment shown, which is more precisely disclosed in U.S. application Ser. No. 505,134, filed June 16, 1983, an integrally formed eyestay and pistol-grip shaped pocket portion 21 overlies and is stitched to the shoe quarter via stitches 22 about its peripheral edges. The pocket forming portion 21 is provided with a cutout area comprising a window opening 25 behind which is positoned a transparent window 26 of suitable flexible material. The peripheral edges of the window opening 25 are normally stitched to prevent fraying and in the instance of the present construction, the edges of the plastic window 26 and the peripheral edges of the window opening 25 are stitched together in the same stitching operation, as at 28, to stabilize the window in place. The window may, as with the construction of the display insert, discussed below, instead of being stitched to the inner surface of the outer material, conform at its periphery to the shape of the pocket boundaries along the sides and bottom and thus be stabilized within the pocket without the necessity of stitching.

A display insert, for example an information card 30, is disposed behind the window and is inserted in the pocket area between the pocket forming portion 21 and the shoe quarter 16 through pocket access opening 40, which, in the present embodiment, is provided with a zipper closure 41. Preferably, the card is made of a flexible rugged material, although any material upon which indicia may be displayed is acceptable.

In the particular embodiment shown in the drawings, the outer periphery of the card is shaped substantially to the size and shape of the inner boundaries of the pocket area at least along the sides and bottom. Thus, in FIG. 1, the shape of the card is shown by the dot-dash line 50 substantially shaped in that manner along the side and bottom edges thereof.

Now it can be appreciated that the information display card can be inserted through the access opening 40 and removed through the access opening and that the simple construction of the invention provides a means of seeing what is in the pocket of the shoe or for displaying the users name and other personal information on a display card; and also provides the manufacturer a manner of initially displaying its trademark.

The invention also provides the manufacturer with a construction in which a display is provided without the necessity of stitching the window or display insert against movement. Preferably, however, inasmuch as the window opening will, in the course of good fabrication processes, be stitched to prevent fraying, the window will ordinarily be stitched to the outer material behind the window opening in the same stitching operation.

Many variations of the invention can now be derived from the disclosure of my invention which should, therefore, be limited only as set forth in the following claims.

What is claimed is:

1. An athletic shoe or the like having a quarter portion extending forwardly and on either side of the longitudinal center line of said shoe, dividing an upper central eyestay opening, outer material overlying the said quarter portion, said outer material forming eyestay portions on either side of said eyestay opening, said outer material also forming a saddle portion extending integrally from said eyestay portion toward the sole of said shoe, means stitching said outer material to said quarter along the periphery of said outer material, along the edges of said opening and along the forward, rearward and lowermost edges thereof, access means at an upper portion of said outer material below one of said eyestay portions providing access to the space between said outer material and said quarter, said outer material being formed with a window display opening spaced from said access means and wherein indicia display means are inserted between said outer material and said quarter behind said window display opening, a transparent window is interposed between said display means and said window display opening and is stitched to said outer material, said indicia display means comprises a card, said stitching means forming a pocket area between said quarter and said outer material, the peripheral edges of said card substantially conforming to the size and shape of the inner peripheral boundaries of said poocket area, said access means being provided with closure means.

2. A method of fabricating a display area in a shoe having a quarter portion and outer material covering at least a portion of said quarter portion, comprising: forming the outer material as an integral eyestay portion and a depending outer pocket layer, forming a window opening in the outer material in the depending outer pocket layer, and forming an access opening spaced from the window adjacent the eyestay portion; stitching the outer peripheral edges of a transparent window to the outer material behind the window opening, stitching the outer material to the quarter portion inserting a display element through the access opening behind the window opening; and first shaping the edges of the element to conform substantially to the sides and bottom of the area defined by the stitching of the outer material to the quarter.

* * * * *